US006899565B2

(12) United States Patent
Kodera et al.

(10) Patent No.: US 6,899,565 B2
(45) Date of Patent: May 31, 2005

(54) ELECTRICAL CONNECTOR HAVING A HOLDDOWN FOR GROUND CONNECTION

(75) Inventors: Masafumi Kodera, Akishima (JP); Joe Motojima, Akishima (JP); Akira Natori, Fussa (JP); Keiichiro Suzuki, Kodaira (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/786,999

(22) Filed: Feb. 25, 2004

(65) Prior Publication Data

US 2004/0166707 A1 Aug. 26, 2004

(30) Foreign Application Priority Data

Feb. 26, 2003 (JP) ..... 2003-048660

(51) Int. Cl.[7] ..... H01R 13/648
(52) U.S. Cl. ..... 439/607; 439/95
(58) Field of Search ..... 439/95, 607

(56) References Cited

U.S. PATENT DOCUMENTS 5,882,223 A * 3/1999 Igarashi ..... 439/495
6,089,882 A * 7/2000 Costello ..... 439/95
6,213,790 B1 * 4/2001 Kakinoki et al. ..... 439/95
6,361,365 B1 * 3/2002 Yu ..... 439/607

FOREIGN PATENT DOCUMENTS

| | | |
|---|---|---|
| JP | 8171971 | 9/1997 |
| JP | 9289061 | 11/1997 |
| JP | 11031556 | 2/1999 |

* cited by examiner

*Primary Examiner*—Phuong Dinh
(74) *Attorney, Agent, or Firm*—Collard & Roe, P.C.

(57) ABSTRACT

An electrical connector comprises an insulator to be mounted to a substrate, a conductive cover member coupled to the insulator, and a conductive holddown held by the insulator to connect the cover member and a ground conductor portion formed on the substrate. The cover member has first and second cover contacting portions. The holddown has a holddown contacting portion extending to face an outer surface of a side wall portion of the insulator. The holddown contacting portion is clamped between the first and the second cover contacting portions in a direction along the outer surface of the side wall portion.

7 Claims, 6 Drawing Sheets

ELECTRICAL CONNECTOR HAVING A HOLDDOWN FOR GROUND CONNECTION

This application claims priority to prior Japanese application JP 2003-48660, the disclosure of which is incorporated herein by reference.

BACKGROUND OF THE INVENTION

This invention relates to an electrical connector adapted to receive a thin card, such as an IC card, which is inserted into the electrical connector to be connected thereto.

An existing electrical connector of the type comprises a plurality of conductive contacts, an insulator holding the contacts, a conductive cover member attached to the insulator, and a plurality of conductive holddowns held by the insulator.

The insulator is adapted to be mounted on a printed circuit board. The insulator has a base portion and a pair of side wall portions standing up from the base portion. Each of the base portion and the side wall portions of the insulator has a thin flat-plate shape.

The cover member has a cover main plate portion having a flat plate shape and faced to the base portion of the insulator, a pair of cover side plate portions extending from opposite sides of the cover main plate portion to face outer surfaces of the side wall portions of the insulator, respectively, and a plurality of pressing spring portions formed on the cover side plate portions, respectively. The pressing spring portions are formed on the cover side plate portions in one-to-one correspondence to the holddowns.

Each of the holddowns has a holding portion held by each of the side wall portions of the insulator, and a connecting portion to be connected by soldering to a ground conductor portion formed on the printed circuit board.

The cover member and the ground conductor portion of the printed circuit board are connected through the holddowns by pressing the pressing spring portions to the holddowns. Each of the contacts has a terminal portion to be connected by soldering to a signal conductor portion of the printed circuit board.

As described above, the holddowns are pressed by the pressing spring portions of the cover member. Therefore, a whole of the insulator including the base portion and the side wall portions each of which has a thin flat-plate shape may be deformed under a load exerted by the pressing force.

In particular, the insulator made of a resin material and having a thin flat-plate shape is significantly decreased in rigidity if a reflow temperature for soldering is high.

In case where the insulator is pressed by the pressing spring portions and largely deformed, the flatness in arrangement of the terminal portions of the contacts is impaired. In this event, the terminal portions can not be soldered to the signal conductor portion formed on the printed circuit board. Thus, connection is unsuccessful when the electrical connector is mounted to the printed circuit board.

Japanese Patent Application Publication (JP-A) No. H8-171971 discloses an IC socket in which a seating member of a cover stopper formed on a socket body is soldered to a conductive pattern of a printed wiring board.

Japanese Patent Application Publication (JP-A) No. H09-289061 discloses an electrical connector in which a holddown for fixing a housing onto a circuit board is connected to a ground pattern of the circuit board.

Japanese Patent Application Publication (JP-A) No. H11-31556 discloses a PC card connector in which a cover is connected to a ground pattern of a mounting substrate.

However, none of the above-mentioned publications teaches a countermeasure for preventing the base portion and the side wall portions of a thin flat-plate shape from being deformed under the load by the pressing force of the pressing spring portions.

SUMMARY OF THE INVENTION

It is an object of this invention to provide an electrical connector in which a contact is reliably soldered to a ground conductor portion of a printed circuit board without deformation of an insulator and impairment in flatness of a contact array.

According to this invention, there is provided an electrical connector comprising a conductive contact, an insulator holding the contact and adapted to be mounted to a substrate, a conductive cover member held by the insulator, and a conductive holddown held by the insulator to connect the cover member and a ground conductor portion of the substrate, wherein:

the insulator has a base portion holding the contact and a side wall portion extending from the base portion;

the cover having a cover main plate portion faced to the base portion, a cover side plate portion extending from one side of the cover main plate portion to face an outer surface of the side wall portion, a first cover contacting portion formed on the cover main plate portion in the vicinity of the cover side plate portion, and a second cover contacting portion formed on the cover side plate portion;

at least one of the first and the second cover contacting portions having elastic restoring force;

the holddown having a holddown contacting portion extending across the side wall portion to the outside of the side wall portion to face the outer surface of the side wall portion;

the holddown contacting portion being located between the first and the second cover contacting portions and clamped by the first and the second cover contacting portions in a direction along the outer surface of the side wall portion.

BRIEF DESCRIPTION OF THE DRAWING

FIG. 2—2 is an enlarged sectional view taken along line 2—2 in FIG. 1;

FIG. 2'—2' is an enlarged sectional view taken along line 2'—2' in FIG. 1;

DESCRIPTION OF THE PREFERRED EMBODIMENT

Now, description will be made of an electrical connector according to an embodiment of this invention.

Figure 1:
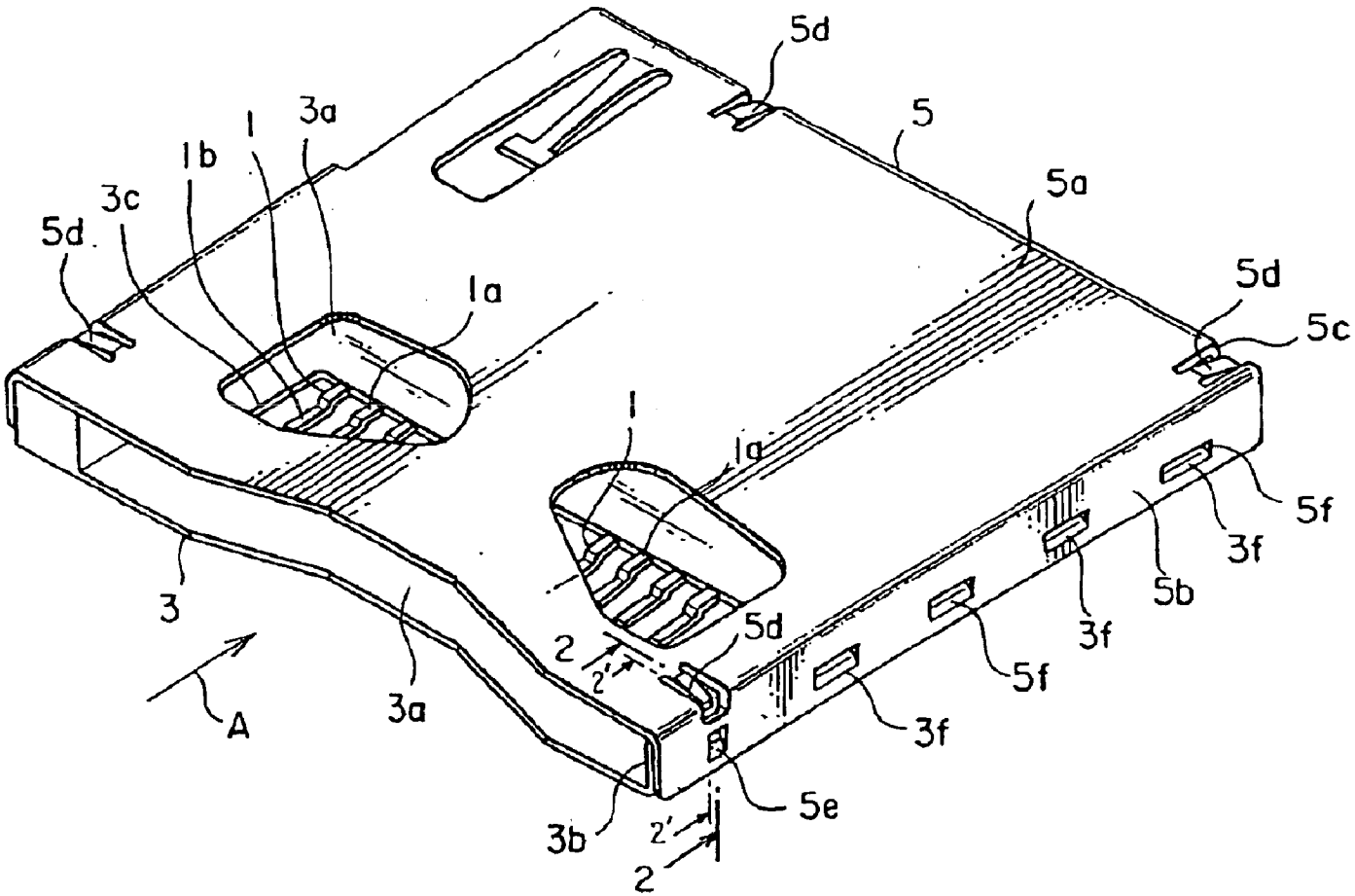
FIG. 1 is a perspective view of an electrical connector according to an embodiment of this invention.
Figure 2:
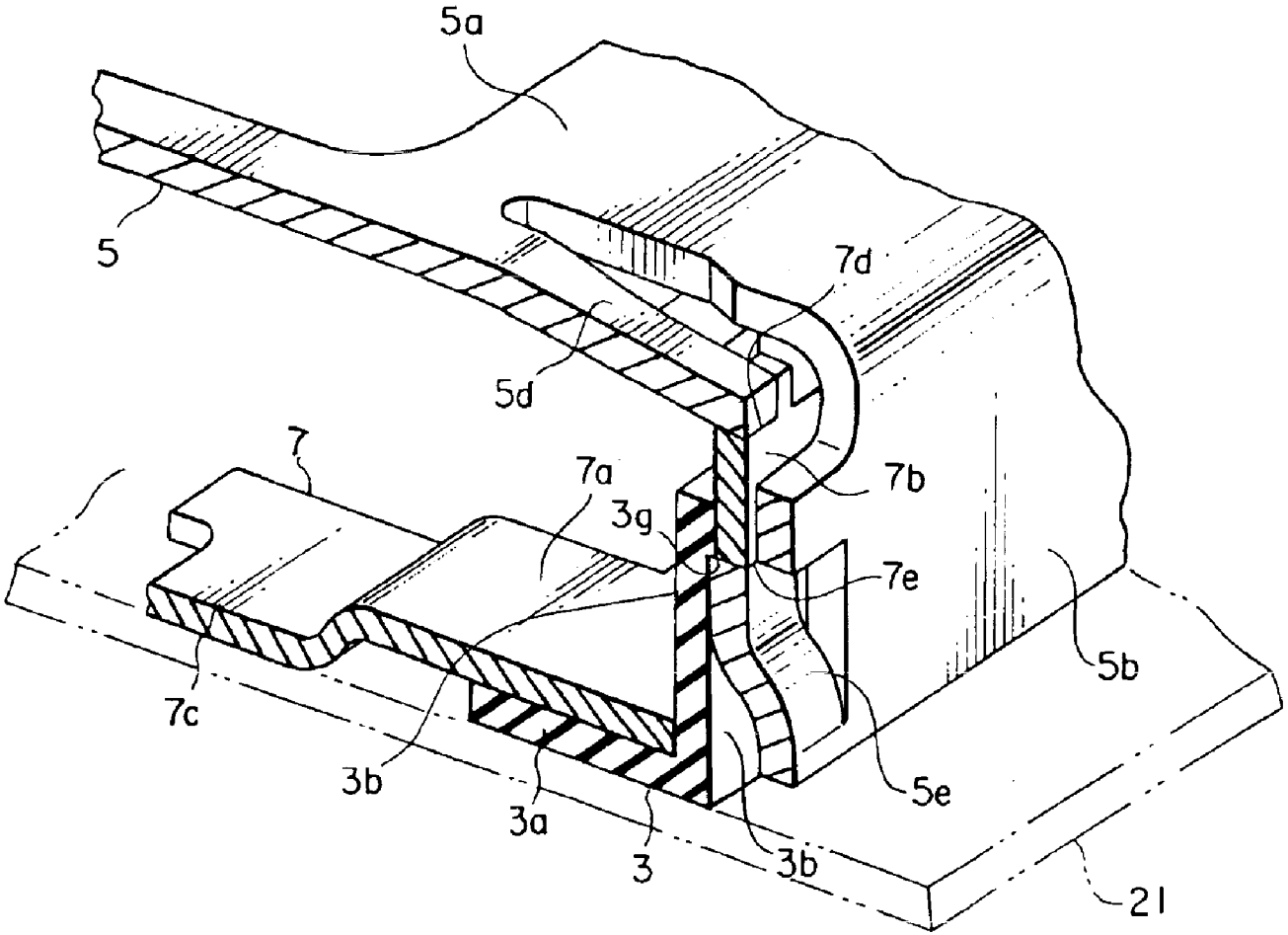
FIG. 2 is an enlarged perspective and sectional view taken along a line 2—2 in FIG. 1.
Figure 2:
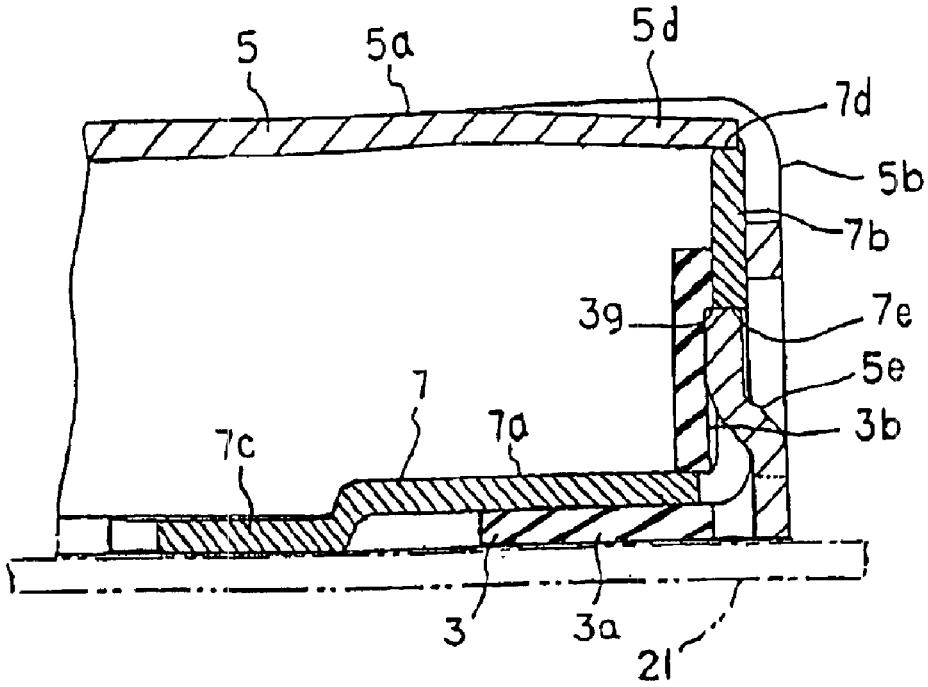
Figure 2:
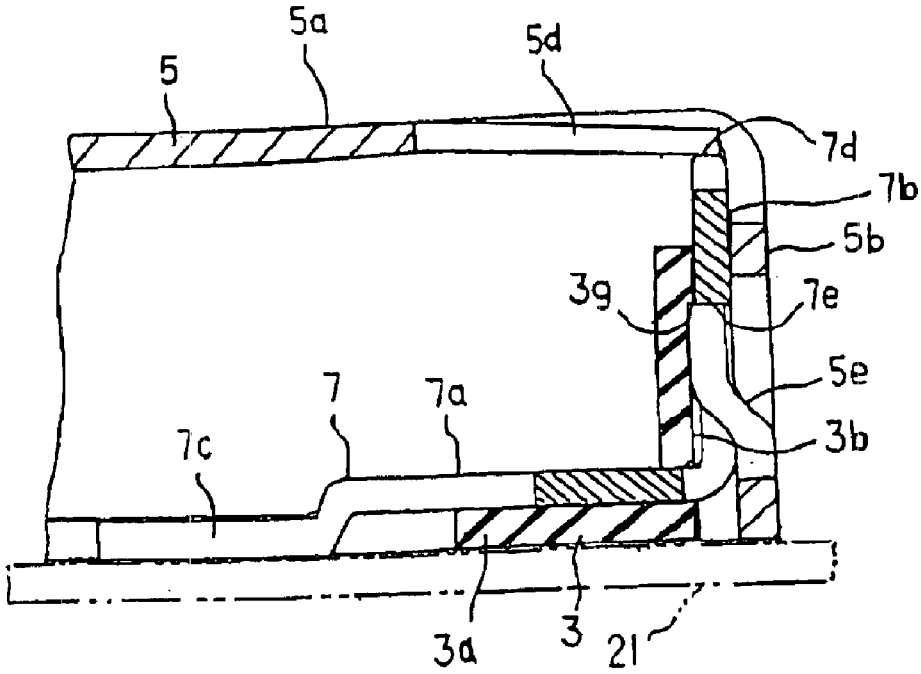
Figure 3:
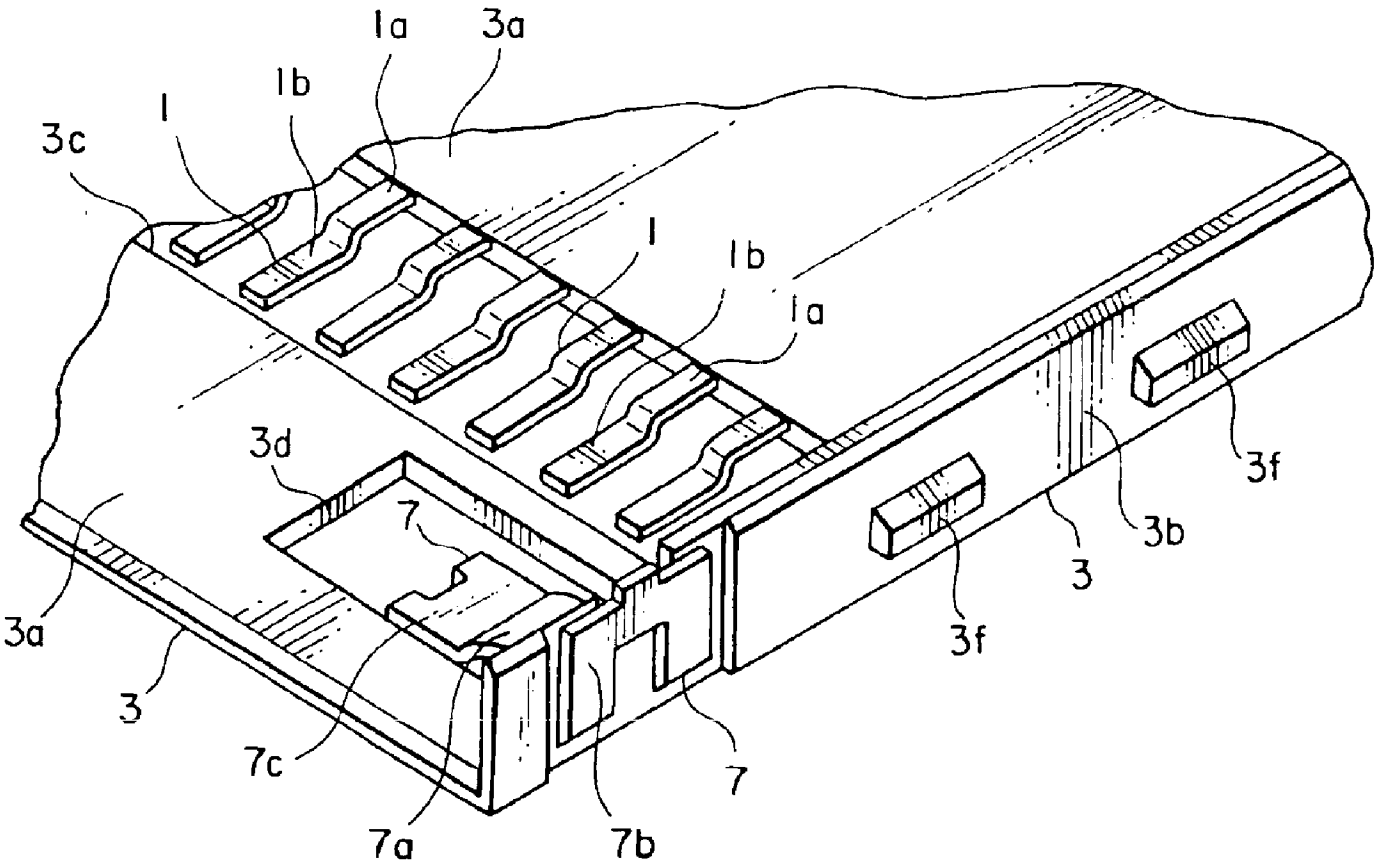
FIG. 3 is an enlarged perspective view of the electrical connector without a cover member illustrated in FIG. 1.

Referring to FIGS. 1 through 3, the electrical connector comprises a plurality of conductive contacts 1 arranged in parallel to one another with a space left from one another, an insulator 3 holding the contacts 1, a cover member 5 integrally attached to the insulator 3, and a plurality of conductive holddowns 7 held by the insulator 3.

Each of the contacts 1 has a contact point portion 1*a* to be contacted with a card contact point portion of a card (not shown), and a terminal portion 1*b* extending outward from the insulator 3. The terminal portion 1*b* is connected to a signal conductor portion (not shown) of a substrate 21 by soldering.

The insulator 3 is mounted on the substrate 21, such as a printed circuit board. The insulator 3 has a thin-plate base portion 3*a* holding the contacts 1, and a pair of thin-plate side wall portions 3*b* extending from opposite sides of the base portion 3*a* parallel to each other. The side wall portions 3*b* are faced to each other on an inner surface of the base portion 3*a*.

The base portion 3*a* is provided with a first base opening 3*c* to allow the terminal portions 1*b* to be soldered to the substrate 21.

Although not shown in the figure, the insulator 3 has another side wall portion formed at a rear end in FIG. 1 and connected between the side wall portions 3*b*. The above-mentioned another side wall portion may be called a rear wall portion for convenience of description.

The cover member 5 covers the insulator 3. The insulator 3 and the cover member 5 are integrally coupled to form a housing as a whole. The cover member 5 is formed by press punching and bending a conductive metal plate.

Figure 4:
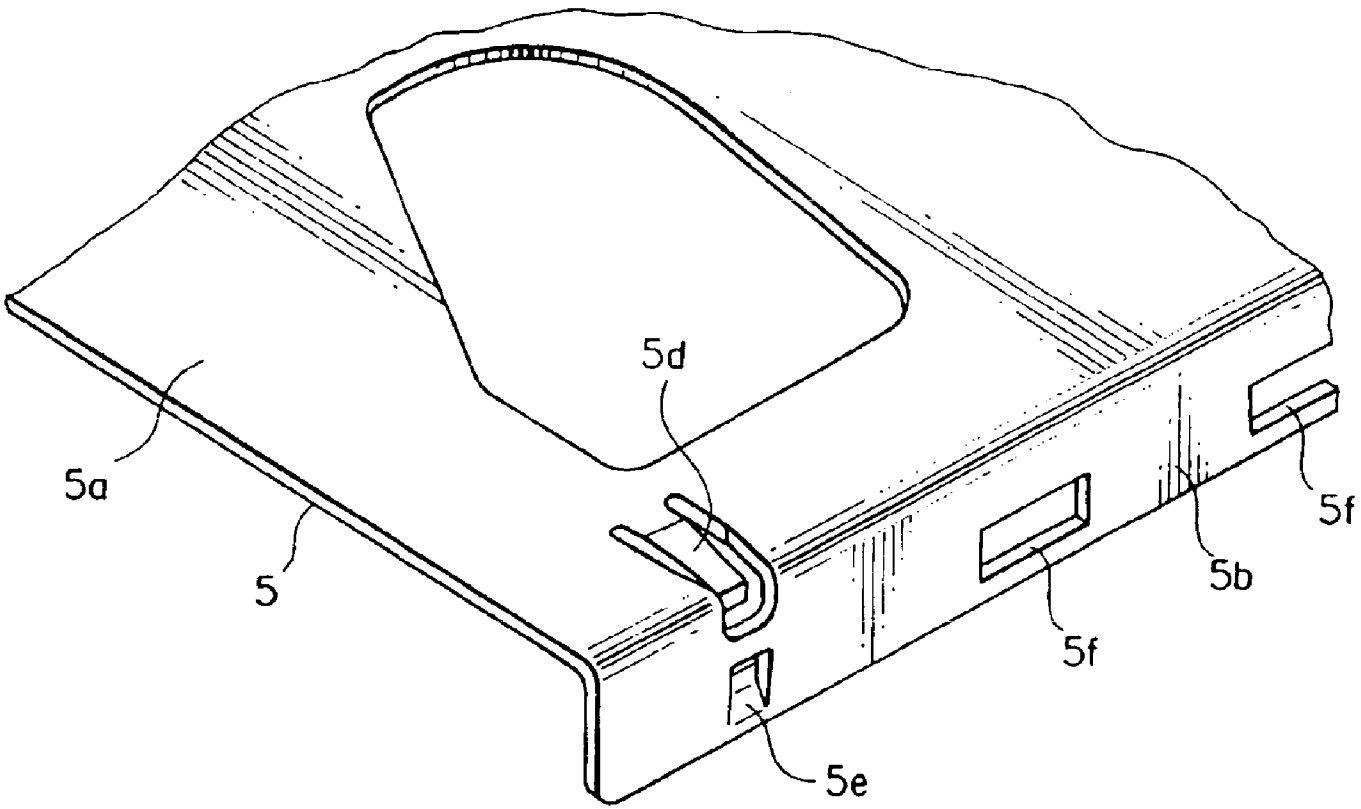
FIG. 4 is an enlarged perspective view of the cover member illustrated in FIG. 1.

As shown in FIG. 4 also, the cover member 5 has a flat-plate cover main plate portion 5*a* faced to the inner surface of the base portion 3*a* at a predetermined space, a pair of cover side plate portions 5*b* bent from opposite sides of the cover main plate portion 5*a* to face outer surfaces of the side wall portions 3*b*, respectively, and a cover rear plate portion 5*c* bent from a rear end of the cover main plate portion 5*a* to face the rear wall portion of the insulator 3 described above.

The cover member 5 has a plurality of first cover contacting portions 5*d* of a cantilevered shape and a plurality of second cover contacting portions 5*e* of a cantilevered shape. Each of the first cover contacting portions 5*d* extends from the cover main plate portion 5*a* towards the cover side wall portion 5*b*.

Each of the first cover contacting portions 5*d* is formed by cutting a part of the cover main plate portion 5*a* and a part of the cover side plate portion 5*b*. Each of the second cover contacting portions 5*e* is formed by cutting a part of the cover side plate portion 5*b* in the vicinity of the first cover contacting portion 5*d*.

In a space between the inner surface of the base portion 3*a* of the insulator 3 and the cover main plate portion 5*a* of the cover member 5 faced thereto, the card is inserted in an insert direction depicted by an arrow A in FIG. 1. When the card is inserted into the space between the inner surface of the base portion 3*a* of the insulator 3 and the cover main plate portion 5*a*, the card contact point portion of the card is brought into contact with the contact point portion 1*a* formed at one end of the contact 1.

The cover side plate portions 5*b* of the cover member 5 are faced to the outer surfaces of the side wall portions 3*b* of the insulator 3. Each of the first cover contacting portions 5*d* has a base connected to the cover main plate portion 5*a* and has elastic restoring force. Each of the second cover contacting portions 5*e* has a base connected to the cover side plate portion 5*b* and has elastic restoring force.

As illustrated in FIG. 1, the cover member 5 in this embodiment is provided with the first and the second cover contacting portions 5*d* and 5*e* formed at four positions. The holddowns 7 are formed at four positions corresponding to the four positions of the first and the second cover contacting portions 5*d* and 5*e*, respectively.

Each of the holddowns 7 connects a ground conductor portion formed on the substrate 21 and the cover member 5. Each of the holddowns 7 is formed by press punching a conductive metal plate to produce a strip-like conductive metal plate and bending the strip-like conductive metal plate.

Figure 5:
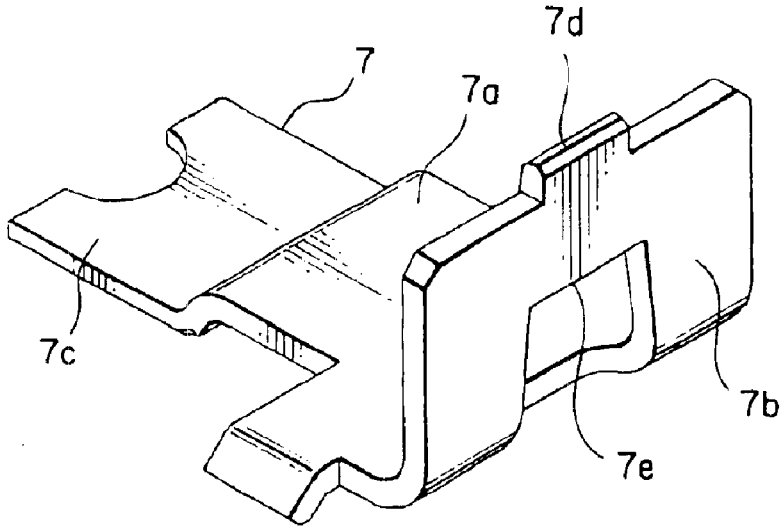
FIG. 5 is an enlarged perspective view of a holddown illustrated in FIGS. 2 and 3.
Figure 6:
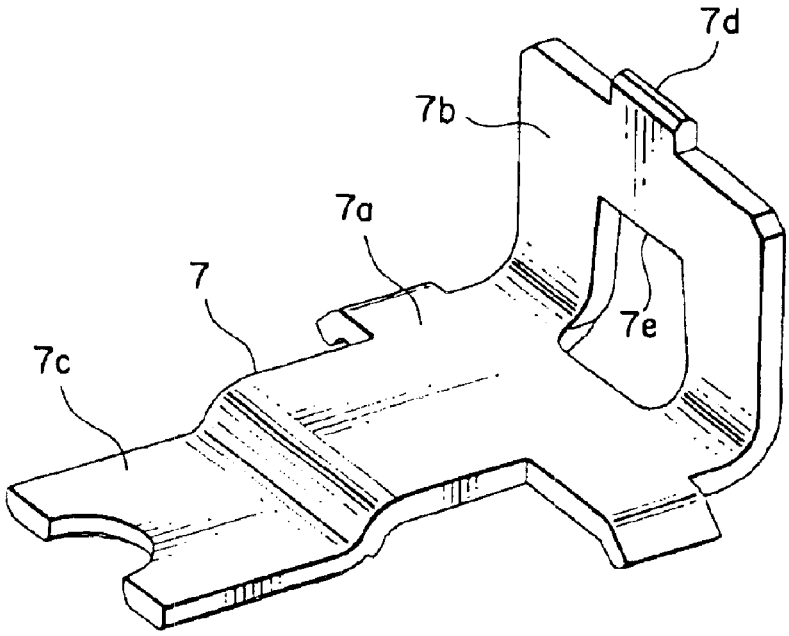
FIG. 6 is an enlarged perspective view of the holddown as seen from a rear side.

As illustrated in FIGS. 5 and 6 also, the holddown 7 has a holding portion 7*a* disposed on the base portion 3*a* of the insulator 3 inside the side wall portion 3*b*, a holddown contacting portion 7*b* extending from the holding portion 7*a* across the side wall portion 3*b* of the insulator 3 to face the outer surface of the side wall portion 3*b*, and a connecting portion 7*c* to be connected to the ground conductor portion (not shown) of the substrate 21. The connecting portion 7*c* extends into a second base opening 3*d* formed in the base portion 3*a*.

The holding portion 7*a* of the holddown 7 is formed by insert molding simultaneously when the insulator 3 is molded, and is held by the insulator 3. When the base portion 3*a* of the insulator 3 is mounted to the substrate 21, the connecting portion 7*c* of the holddown 7 is connected to the ground conductor portion of the substrate 21 by soldering.

The holddown contacting portion 7*b* has a first contact point portion 7*d* contacted with the first cover contacting portion 5*d* and a second contact point portion 7*e* contacted with the second cover contacting portion 5*e*.

Thus, the holddown contacting portion 7*b* is located between the first and the second cover contacting portions 5*d* and 5*e* and clamped by the first and the second cover contacting portions 5*d* and 5*e*. The first cover contacting portion 5*d* has a free end having one plate surface pressed against the first contact point portion 7*d* on an upper end face of the holddown contacting portion 7*b* with elastic force, as illustrated in FIG. 2. The second cover contacting portion 5*e* has an end face (along a plate thickness) kept in contact with the second contact point portion 7*e* on a lower end face of the holddown contacting portion 7*b*.

Thus, the first contact point portion 7*d* is faced to and kept in contact with the free end of the first cover contacting portion 5*d* in a direction intersecting with the plate surface of the free end. The second contact point portion 7*e* is faced to and kept in contact with the end face of the second cover contacting portion 5*e*.

As mentioned above, the holddown contacting portion 7*b* is clamped between the first and the second cover contacting portions 5*d* and 5*e* extending in directions generally perpendicular to each other. The holddown contacting portion 7*b* is kept in contact with the first and the second cover contacting portions 5*d* and 5*e* at the first and the second contact point portions 7*d* and 7*e*, respectively.

With the above-mentioned structure, the first and the second cover contacting portions 5*d* and 5*e* do not locally impose a pressing load upon the side wall portions 3*b* of the insulator 3. Therefore, no pressing load deforming the insulator 3 as a whole is applied.

The side wall portion 3*b* is provided with a step portion 3*g* formed on the outer surface thereof and kept in contact with a part of the end face of the second cover contacting portion 5*e*.

The electrical connector is assembled in the following manner. At first, the insulator 3 is formed by molding a resin material. At this time, the holding portion 7*a* of the holddown 7 is formed by insert molding together with the insulator 3 so that the holding portion 7*a* is held on the insulator 3. At the molding, a plurality of engaging protrusions 3*f* for fitting the cover 5 to the outer surfaces of the side wall portions 3*b* and the first and the second base openings 3*c* and 3*d* are formed.

A plurality of engaging holes 5*f* to be engaged with the engaging protrusions 3*f* are formed in the cover member 5. The cover member 5 is held by the insulator 3 by fitting and engaging the engaging protrusions 3*f* and the engaging holes 5*f* in one-to-one correspondence. Simultaneously, the free end of the first cover contacting portion 5*d* is brought into contact with the first contact point portion 7*d* of the holddown contacting portion 7*b*. The end face of the second cover contacting portion 5*e* is brought into contact with the second contact point portion 7*e* of the holddown contacting portion 7*b*. Then, the holddown contacting portion 7*b* is clamped by the first and the second cover contacting portions 5*d* and 5*e* in a direction along the outer surface of the side wall portion 3*b*.

The electrical connector assembled as mentioned above is mounted on the substrate 21. At this time, the connecting portion 7*c* of the holddown 7 is soldered and connected to the ground conductor portion of the substrate 21. Then, the cover member 5 and the ground conductor portion of the substrate 21 are connected through the first cover contacting portion 5*d*, the holddown contacting portion 7*b*, the holding portion 7*a*, and the connecting portion 7*c*.

The first and the second cover contacting portions 5*d* and 5*e* are also formed at the rear end in FIG. 1. At the rear end of the electrical connector, each of the first cover contacting portions 5*d* extends from the cover main plate portion 5*a* towards the cover rear plate portion 5*c*. Each of the second cover contacting portions 5*e* is formed by cutting a part of the cover rear plate portion 5*c* in the vicinity of the first cover contacting portion 5*d*. In the manner similar to that mentioned above, the first and the second cover contacting portions 5*d* and 5*e* are kept in contact with the first and the second contact point portions 7*d* and 7*e* of the holddown contacting portion 7*b* of each of the holddowns 7 arranged at the rear end.

At least one of the first and the second cover contacting portions 5*d* and 5*e* has elasticity.

As described above, in the electrical connector according to this invention, the holddown contacting portion 7*b* is located between the first and the second cover contacting portions 5*d* and 5*e* and clamped by the first and the second cover contacting portions 5*d* and 5*e*. Therefore, even if the cover member 5 and the ground conductor portion of the substrate 21 are connected with sufficient contact force, the insulator 3 is prevented from being deformed. Therefore, the flatness in arrangement of the contacts 1 with respect to the signal conductor portion of the substrate 21 is not impaired and the contacts 1 can be soldered to the signal conductor portion with reliability.

While this invention has thus far been described in conjunction with the preferred embodiment thereof, it will be readily possible for those skilled in the art to put this invention into practice in various other manners.

What is claimed is:

1. An electrical connector comprising a conductive contact, an insulator holding the contact and adapted to be mounted to a substrate, a conductive cover member held by the insulator, and a conductive holddown held by the insulator to connect the cover member and a ground conductor portion of the substrate, wherein:

the insulator has a base portion holding the contact and a side wall portion extending from the base portion;

the cover having a cover main plate portion faced to the base portion, a cover side plate portion extending from one side of the cover main plate portion to face an outer surface of the side wall portion, a first cover contacting portion formed on the cover main plate portion in the vicinity of the cover side plate portion, and a second cover contacting portion formed on the cover side plate portion;

at least one of the first and the second cover contacting portions having elastic restoring force;

the holddown having a holddown contacting portion extending across the side wall portion to the outside of the side wall portion to face the outer surface of the side wall portion;

the holddown contacting portion being located between the first and the second cover contacting portions and clamped by the first and the second cover contacting portions in a direction along the outer surface of the side wall portion.

2. An electrical connector according to claim 1, wherein the first cover contacting portion has a cantilevered shape and is formed by cutting a part of the cover main plate portion and a part of the cover side plate portion while the second cover contacting portion has a cantilevered shape and is formed by cutting a part of the cover side plate portion.

3. An electrical connector according to claim 1, wherein the holddown further has a holding portion held by the insulator and a connecting portion extending from the holding portion and located in a base opening formed in the base portion to be connected to the ground conductor portion;

the holddown contacting portion having a first contact point portion kept in contact with the first cover contacting portion and a second contact point portion kept in contact with the second cover contacting portion.

4. An electrical connector according to claim 3, wherein the insulator is made of a resin material, the holding portion of the holddown being formed by insert molding simultaneously when the insulator is molded, so that the holding portion is held by the insulator.

5. An electrical connector according to claim 3, wherein the holddown has a strip-like plate shape, the first contact point portion being kept in contact with the first cover contacting portion and faced to the first cover contacting portion in a direction intersecting with a plate surface of a free end of the first cover contacting portion, the second contact point portion being kept in contact with the second cover contacting portion and faced to an end face of the second cover contacting portion.

6. An electrical connector according to claim 1, wherein the holddown contacting portion extends along the side wall portion, the connecting portion extending to a base opening formed in the base portion.

7. An electrical connector according to claim 1, wherein the side wall portion is provided with a step portion kept in contact with a part of the end face of the second cover contacting portion.

* * * * *